United States Patent [19]

Dempsey et al.

[11] Patent Number: 4,491,043

[45] Date of Patent: Jan. 1, 1985

[54] STEPLESS WRENCH INCLUDING QUICK RELEASE MECHANISM

[76] Inventors: John D. Dempsey, 2024 Rivermont Ave., Lynchburg, Va. 24503; Jock D. Dempsey, Rte. 2, Box 407, Gladys, Va. 24554

[21] Appl. No.: 242,314

[22] Filed: Mar. 10, 1981

[51] Int. Cl.[3] ..... B25B 13/00

[52] U.S. Cl. ..... 81/58; 81/59.1; 81/62; 192/45.1

[58] Field of Search ..... 81/60–63.2, 81/58, 59.1, 58.2; 192/43, 45.1

[56] References Cited

U.S. PATENT DOCUMENTS

| | | | |
|---|---|---|---|
| 564,250 | 7/1896 | Knowlton . | |
| 892,408 | 7/1908 | Custer . | |
| 1,372,453 | 3/1921 | Radford | 81/59.1 |
| 1,655,865 | 1/1928 | Hooper | 81/59.1 |
| 1,983,123 | 12/1934 | Dodge | 81/59.1 |
| 2,957,377 | 10/1960 | Hare | 81/63.2 |
| 3,362,267 | 1/1968 | Rozmus . | |
| 3,393,587 | 7/1968 | Jolliff et al. | 81/63.2 |
| 3,438,291 | 4/1969 | Bergquist . | |
| 3,532,013 | 10/1970 | Haznar . | |
| 3,621,739 | 11/1971 | Seablom . | |
| 3,638,519 | 2/1972 | Rebold . | |
| 3,659,484 | 5/1972 | Scodeller | 81/63 |
| 3,783,703 | 1/1974 | Trimble et al. | 81/58.1 |
| 3,958,470 | 5/1976 | Lee | 81/63 |
| 4,051,935 | 10/1977 | Nakayama . | |
| 4,307,632 | 12/1981 | Penner | 81/63 |

*Primary Examiner*—James L. Jones, Jr.

*Attorney, Agent, or Firm*—Fleit, Jacobson, Cohn & Price

[57] ABSTRACT

A friction mechanism and a fixture-securing and releasing mechanism, disclosed in the context of a stepless, free-wheeling wrench with thumb-actuated reverse mechanism, speed-wheel, and socket release. The wrench includes a driving member in the form of a wrench head. Mounted for relative rotational movement within a cavity provided in the head is a driven member in the form of a friction wheel assembly which terminates in a drive tang for releasably receiving a hollow socket member. The wrench also includes a speed-wheel forming part of the friction wheel assembly. The speed-wheel is conveniently located on the side of the wrench opposite to that of the drive tang. Concentric with the speed-wheel is a plunger, which together with a disc located in the drive tang, forms a part of a quick release mechanism that allows a socket to be simply pushed into position with relatively low force, while requiring relatively high force to pull the socket off the tang prior to pushing a release button. Located on the same side of the housing as the speed-wheel, but spaced therefrom, is a thumb switch which is movable into one of three positions in order to determine in which direction the friction wheel assembly will turn in response to a force supplied to the handle of the wrench.

33 Claims, 29 Drawing Figures

FIG. 4
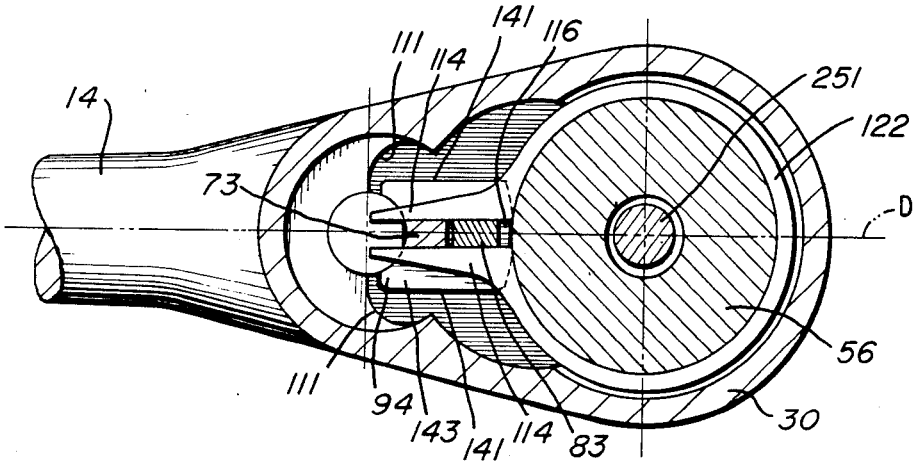
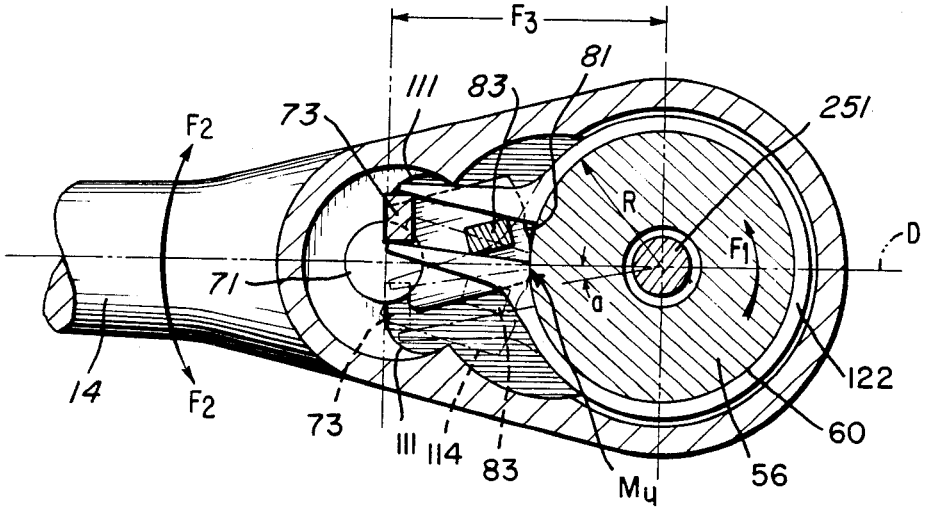
FIG. 5

FIG. 24
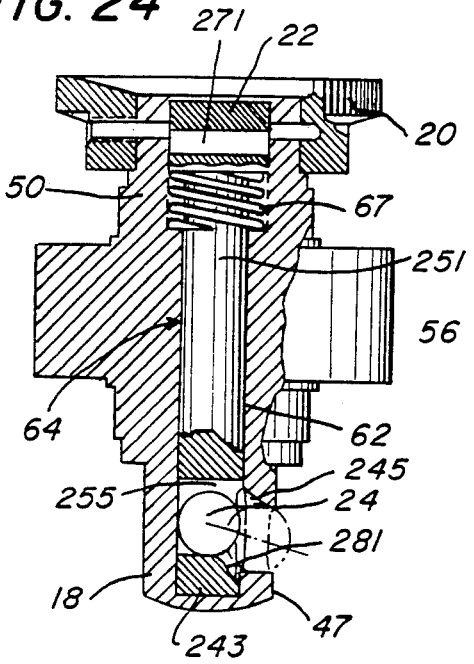
FIG. 25
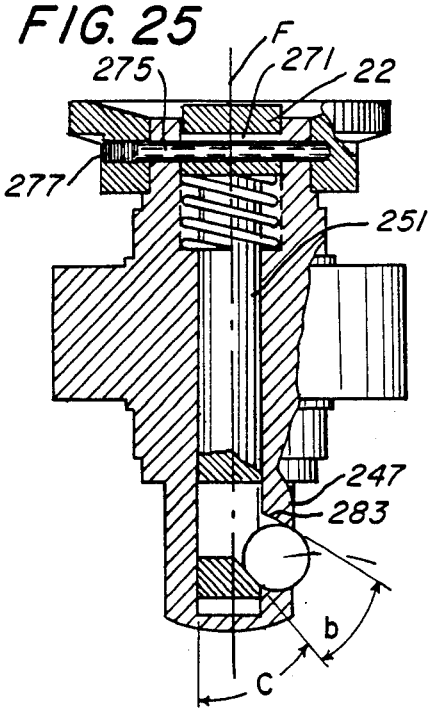
FIG. 27
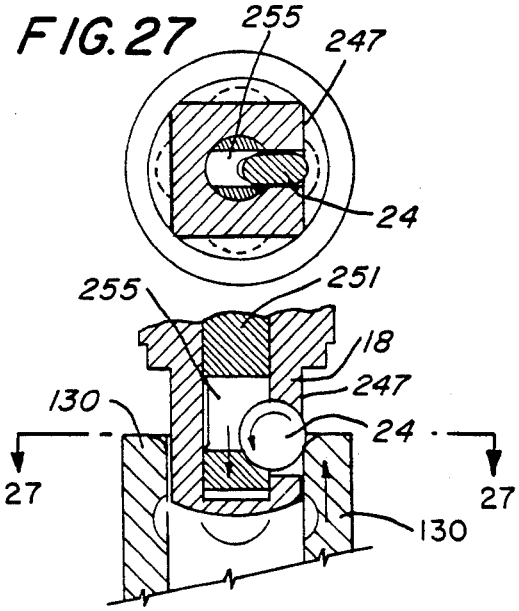
FIG. 26
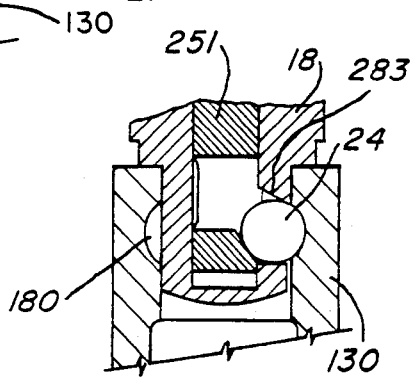
FIG. 28
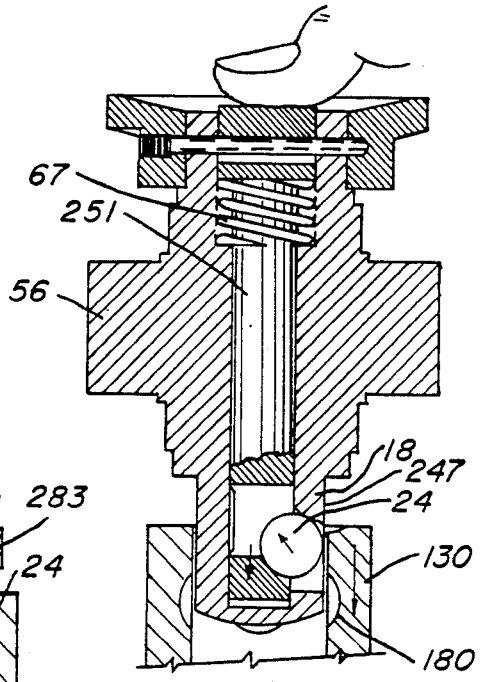
FIG. 29

STEPLESS WRENCH INCLUDING QUICK RELEASE MECHANISM

BACKGROUND OF THE INVENTION

1. Field of the Invention

The present invention relates to a friction mechanism, in general, and to a stepless free-wheeling wrench with thumb actuated reverse mechanism, speed-wheel, and socket release, in particular.

2. Description of the Prior Art

Reversible socket wrenches have been known for some time. Typically, such a wrench consists of a main body portion containing a long handle for effective leverage in turning. In terms of a generalized description of a friction movement, this could be considered as the driving member. Mounted for rotational movement about its axis within the body of the driving member is a tang assembly which may be considered as the driven member. Typically, through a ratchet and pawl mechanism or, more recently, a stepless torque mechanism, a manual force applied to the handle of the wrench is transferred through the wrench body to the tang assembly, the end of which receives a socket or fixture for turning a bolt, screw, fastener or the like. Provision is made within the wrench so that a clockwise or counterclockwise turning of the fastener may take place. When a stepless torque mechanism is employed, the reversible socket wrench makes use of a friction wheel forming part of the tang assembly. The friction wheel is variously advanced by a plurality of rollers or cams, which, when biased by a spring force, are propelled by friction up an inclined plane or arc, providing a wedging action to increase the frictional force necessary for the desired torque. When either the driven member or the driving member is reversed, the cams or roller members are forced down the inclined plane by friction, thus, releasing the wedging force and allowing free-wheeling or overrunning action to occur. This mechanical movement is commonly known as a free-wheeling or one-way clutch. Socket wrenches employing such a structure operate successfully for very light torque applications when placed in a space envelope common to typical ratchet wrenches. But, when required to produce tortional forces of 200 to 400 foot pounds, which are typical of present ratchet wrench capabilities with a ½ inch square tang drive, internal forces are generated that stress the internal mechanisms and wrench housings of prior art instruments beyond their elastic range, thus, rendering them useless for further work. In addition, an even more serious problem occurs at much lower torques, that is, deflection of the loaded members causes the rollers or cams to stick in the driven position; thus making it difficult, if not impossible, to shift a device into the direction reversed from the last applied torque.

Most prior art stepless wrenches require two hands to shift the mechanism to the reverse driven direction. In addition, when a speed-wheel for spinning down loose fasteners is employed, the speed-wheel is usually inconveniently located at the point where the socket or fixture is secured to the tang in close proximity to the wrench body.

Many of the prior art reversible socket wrenches employ various methods to secure the socket to the wrench square drive tang. Among the known methods is one that employs a snap-on ball detent means, which works very well when attaching the socket to the wrench, requiring only a firm push to engage the socket with the drive tang. However, removing the socket with greasy hands is very difficult and sometimes impossible.

One prior art wrench has provided a convenient method of releasing the socket. However, the device requires a release button to be pushed in order to engage the socket, which is an inefficient trade-off. It is, therefore, desirable to provide a mechanism which will allow the socket to be simply pushed into position with relatively low force, while requiring relatively high force to pull the socket off the tang prior to pushing the release button.

The present invention is directed toward eliminating many of the aforementioned problems associated with the prior art devices by providing a reversible ratchet-like wrench which will advance a fastener in the desired direction with very slight motion of the handle, requiring much less motion than is typically necessary of common fine-tooth ratchet wrenches, thus, providing the ability to tighten a fastener in areas where clearances for handle motion are restricted to 1° or 2° of arc. The reversible ratchet-like wrench of the present invention also contains a speed-wheel conveniently located for rapid spin-down of fasteners, a switch for reversal of the wrench's free-wheeling action, and a novel socket release mechanism, all of which can conveniently be operated with one hand with all of the functions accomplished by thumb actuation. The improved wrench of the subject invention also employs a unique stepless torque mechanism which allows the radius of the head of the wrench to be no greater than commonly found on popular ratchet wrenches.

SUMMARY OF THE INVENTION

The present invention relates to a friction mechanism and a fixture-securing and releasing mechanism, and is disclosed in the context of a stepless, free-wheeling wrench with thumb-actuated reverse mechanism, speed-wheel, and socket release. The wrench basically comprises a driving member in the form of a wrench head from which depends an elongated handle. Mounted for relative rotational movement within a cavity provided in the head of the wrench is a driven member in the form of a friction wheel assembly which terminates in a drive tang for releasably receiving a hollow socket member or other type of fixture. The friction wheel assembly cooperates with a cam assembly also positioned within the cavity in order to selectively impart rotational movement to the drive tang.

The wrench also includes a speed-wheel fixedly mounted to the friction wheel. The speed-wheel is conveniently located on the side of the wrench opposite to that of the drive tang. Concentric with the speed-wheel is a plunger, which together with a disc located in the drive tang, forms a part of a quick release mechanism that allows a socket to be simply pushed into position with relatively low force, while requiring relatively high force to pull the socket off the tang prior to pushing a release button.

Located on the same side of the housing as the speed-wheel, but spaced therefrom, is a thumb switch which is movable into one of three positions in order to determine in which direction the friction wheel assembly will turn in response to a force supplied to the handle of the wrench.

Thus, it is a primary object of the subject invention to provide a stepless torque mechanism particularly suited for use in a socket wrench or similar device containing a driving member and a driven member.

It is another object of the present invention to provide a wrench using a stepless torque mechanism wherein the width and head radius of the wrench are no larger than prior art ratchet wrenches.

It is still an object of the present invention to provide a quick release mechanism that allows a socket to be simply pushed into position on a tool with relatively low force, while requiring relatively high force to pull the socket off of the tool prior to pushing a release button.

It is yet an object of the present invention to provide an arrangement for a release mechanism which requires a smaller diameter detent release plunger than prior art devices.

It is a further object of the present invention to provide a speed-wheel conveniently located on the head of a socket wrench.

It is yet another object of the present invention to provide a shift mechanism which allows for an easily thumb-actuated, selectable-neutral position to enhance the convenient operation of a speed-wheel for spinning loosened fasteners on and off.

These and other objects will become apparent hereinafter when considered together with the detailed description of the invention and the drawings appended thereto.

BRIEF DESCRIPTION OF THE DRAWINGS

FIG. 4 is a longitudinal section taken alone lines 4—4 of FIG. 2 and showing the wrench in its neutral position.

FIG. 5 is a view similar to that of FIG. 4 with the wrench in one of its active positions.

FIG. 24 is a plan view of the friction wheel assembly with a major portion removed to reveal the quick release assembly found in all of the embodiments of the wrench.

FIG. 25 is a view similar to that of FIG. 24.

FIG. 26 is a sectional view revealing the tang portion of the friction wheel assembly of FIG. 24 as it receives a portion of a fixture.

FIG. 27 is a view taken alone lines 27—27 of FIG. 26.

FIG. 28 is a view similar to that of FIG. 26 but showing the fixture fully mounted on the tang.

FIG. 29 is a view similar to that of FIG. 24 with the friction wheel assembly being totally shown in section and illustrating the action necessary to remove the fixture from the drive tang.

DETAILED DESCRIPTION OF THE DRAWINGS

Figure 1:
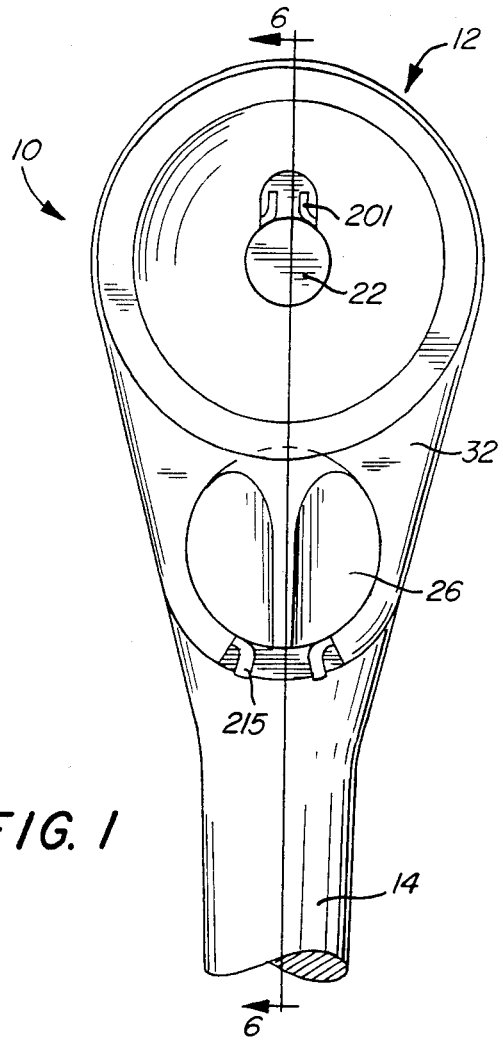
FIG. 1 is a top plan view of a preferred embodiment of the wrench with a portion of the handle removed.
Figure 2:
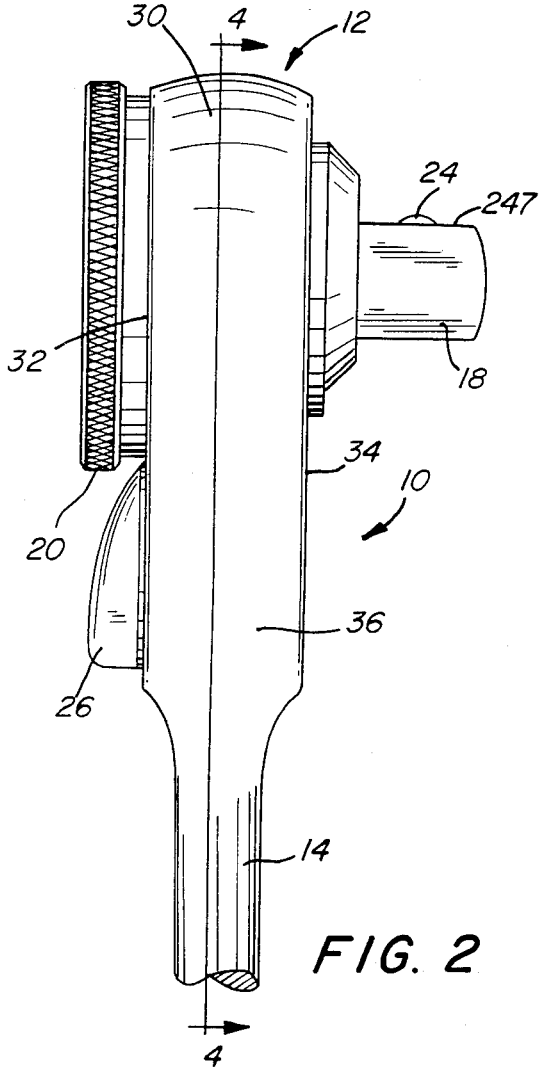
FIG. 2 is a side plan view of the embodiment of FIG. 1, also, with a portion of the handle removed.

In describing preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose. In addition, while the subject invention is disclosed in the context of a socket wrench, it is to be understood that the invention is not to be limited thereto, since other embodiments may be constructed. Some of the other uses to which the subject invention is capable are in screwdrivers, drilling rigs, automotive transmissions, automotive starters, and conveyors, to name a few. Thus, it should be clear that one important aspect of the present invention relates to providing a means for causing intermittent frictional engagement between a driving member and a driven element, thus providing for an improved friction clutch mechanism.

With reference to FIGS. 1 through 10, in general, and 1 through 3, in particular, a preferred embodiment of the wrench, generally designated as 10, basically comprises a driving member in the form of a wrench head 12 from which depends an enlongated handle portion 14 of conventional length. Mounted for relative rotational movement, within the head 12 is a driven member in the form of a continuous, uninterrupted friction wheel assembly 16 which terminates in a drive tang 18 for releasably receiving a hollow socket member or other type of fixture.

The wrench 10 also includes a speed-wheel 20 formed as an integral part of the friction wheel assembly 16. The speed-wheel, which is used primarily for rapid spin-down of fasteners, is conveniently located on the side of the wrench opposite to that of the drive tang 18. Concentric with the speed-wheel is a plunger 251, which together with a disc 24 located in the drive tang 18, forms part of a quick release mechanism, the details of which will be described hereinafter.

Located on the same side of the housing as the speed-wheel, but spaced therefrom, is a thumb switch 26 which is movable into one of three positions in order to determine in which direction the friction wheel assembly 16 will turn in response to a force applied to the handle 14 of the wrench 10.

With reference to FIGS. 1 through 7, the details of the preferred embodiment of the subject invention will be described. The driving member of the wrench 10 has an enlongated main body portion 30 integral with a longitudinally extending enlongated handle 14. The main body portion or head of the wrench defines two substantially planar outer surfaces 32 and 34 spaced a predetermined distance from each other to define a peripheral body wall 36 therebetween. The outer surfaces 32 and 34 are substantially parallel to each other. The body wall 36 merges with the handle at one end of the head. Within the head there is defined a cavity 38 which extends from the distal end of the head in the general direction of the handle. The cavity 38 defines a friction wheel receiving portion 40 and a cam assembly receiving portion 42.

The cavity 38 is defined in the following manner. Originating at surface 34 is a bore 21 whose axis A is substantially perpendicular to the plane defined by the surface 34. The size and depth of bore 21 are chosen to appropriately mate with a bearing housing 23. Originating at surface 32 is a second bore 25 whose axis is coterminous with axis A of bore 21, and whose diameter is greater than the diameter of bore 21. The size and depth of bore 25 are chosen to appropriately mate with a second bearing housing 27.

Positioned between bores 21 and 25 is a cylindrically shaped cut-out 29, whose axis is coterminous with axis A and whose diameter is less than the diameter of bore 25, but greater than the diameter of bore 21. The cut-out 29 and bore 21 and 25 constitute the friction wheel receiving portion 40 of the cavity 38.

Figure 7:
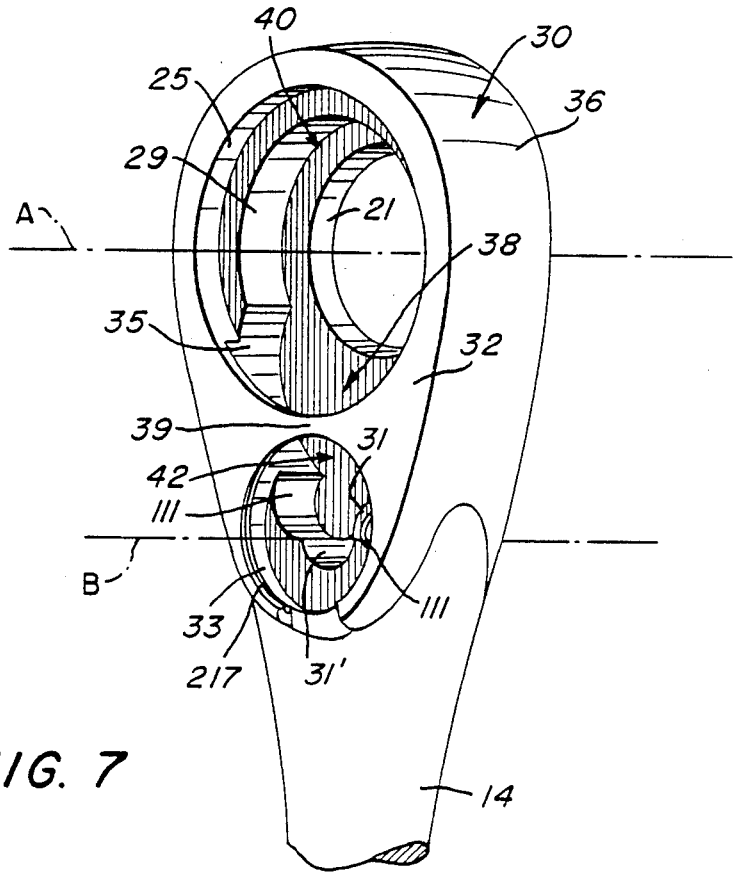
FIG. 7 is a perspective view of the unitary head or main body portion of the wrench.

Spaced from the friction wheel receiving portion 40, in the portion of the head 12 close to the handle 14, is a bore 31 which originates at surface 32 and terminates short of surface 34. The axis B of bore 31 is substantially parallel to axis A. As shown in FIG. 7, the portion of bore 31 closest to surface 32 is cut away so that bore 31 is open as it faces axis A and, thus, defines a semi cylindrical surface 31' having a depth substantially equal to the depth of cut-out 29. Positioned on either side of surface 31' are two curved surfaces which define detents 111 for stopping advancement of the thumb switch 26 in a manner to be described in detail hereinafter. Originating at surface 32 is a bore 33 of sufficient size and depth to receive a portion of the movable thumb switch 26. The axis C of the bore is substantially parallel with axis B, and lies between axes A and B, which together with axis C all lie along the longitudinal axis D of the wrench 10.

To complete the structure of the cavity 38 there is a further cut-out portion 35 which generally defines the cam-receiving portion 42 of the cavity. The cut-out portion 35 provides a continuous open space from a portion of the side surface of the bore 25 to a portion of the side surface of the bore 33 and also defines the bottom surface 37 of reinforcing portion 39, which spans transversely across surface 32.

Figure 6:
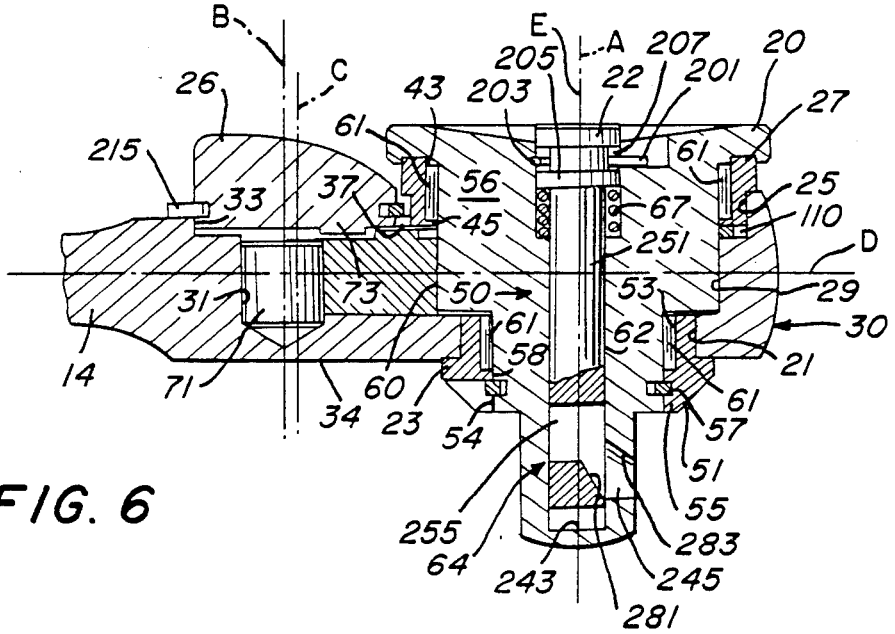
FIG. 6 is a view taken alone lines 6—6 of FIG. 1.

As oriented in FIG. 6, upper bearing housing 27 is a generally ring-shaped member. The outer surface of the member defines a cylindrical surface 39 of a given diameter and another cylindrical surface or flange 41 of greater diameter. The inner surface of the member defines a bearing-receiving surface 43 of generally cylinderal shape. The lowermost portion of the surface 43 terminates in an inwardly extending ring portion 45.

As also oriented in FIG. 6, lower bearing housing 23 is a generally ring-shaped member. The outer surface of the member defines a cylindrical surface 47 of a given diameter and another cylindrical surface or flange 49 of greater diameter with lowermost portion 51 of surface 49 being frustoconical. The inner surface of the member defines a bearing-receiving surface 53 of generally cylindrical shape. The lowermost portion of the surface 53 terminates as an inwardly extending ring portion 55 which contains a retainer-spring receiving groove 57. As will be explained hereinafter, part of the structure of the bearing housing 23, is removed to receive a portion of a retaining spring.

With continued reference to FIG. 6, the upper bearing housing 27 is fixedly mounted, as by press-fit, so that the surface 39 contacts the surface of bore 25 with a portion of the flange 41 contacting surface 32 of the head 12. In like manner the lower bearing housing 23 is fixedly mounted, as by press-fit, so that the surface 47 contacts the surface of bore 21 with a portion of the flange 49 contacting surface 34 of the head 12.

The friction wheel assembly 16 basically comprises an enlongated shaft member 50 which terminates at one end in a conventional, generally square shaped, drive tang 18. Spaced along the shaft member in a direction away from the drive tang, the shaft member 50 has a circumferential portion 54 of predetermined diameter followed by a cylindrical portion 59 of reduced diameter, which, in turn, is followed by a cylindrical portion 58 of predetermined diameter similar to that of cylindrical portion 54. Contiguous with cylindrical portion 58 is a further cylindrical portion 56 of increased diameter which defines a friction wheel 16 that provides, as its outer surface, a friction surface 60 radially disposed about the axis E of the shaft in a closed geometric pattern.

Figure 3:
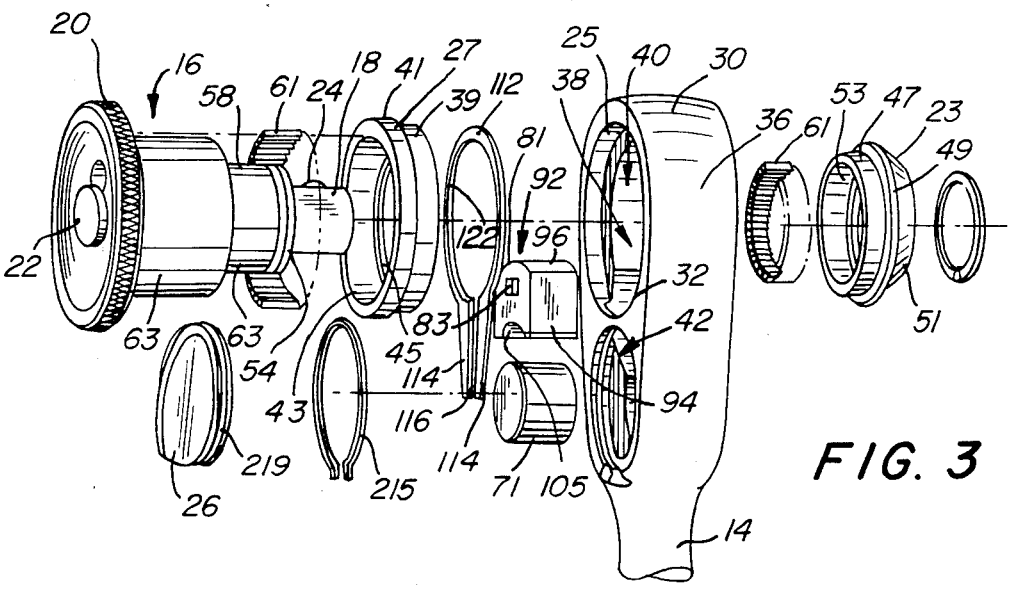
FIG. 3 is an exploded perspective view of the embodiment of FIG. 1.

As best seen in FIGS. 3 and 6, the shaft 50 is disposed within the head of the wrench so that the friction wheel occupies the portion 40 of the cavity 38. A series of bearing rollers 61 are disposed about the circumferences 63, 65 of the cylindrical portions 56, 58. When the friction wheel assembly 16 is mounted within the portion 40 of the cavity 38, the bearings 61 occupy the spaces provided by the bearing housings 23, 27 so that the friction wheel assembly 16 is free to rotate about its axis within the cavity 40 with the bearings rolling against the bearing surfaces 43 and 53.

The friction wheel 56 contains a longitudinally extending bore 62 within which is received the quick release assembly generally designated 64. The details of this assembly will be described in detail hereinafter. At the end opposite to that of the drive tang 18, the friction wheel terminates in the speed wheel 20.

As shown in FIGS. 3 and 6, the thumb switch 26 fixedly receives, as by press fit, an outwardly extending shaft 71 which is received in bore 31 for rotatable mounting. The thumb switch 26 is held in place within bore 33 by a retaining spring 215 that is received in both groove 217 defined in bore 33 and groove 219 defined in the thumb switch. As will be explained in greater detail hereinafter, the thumb switch 26 contains an outwardly projecting shifter pin or boss 73 which cooperates with a cam assembly to determine in which direction the friction wheel assembly 16 will turn in response to a force applied to the handle 14 of the wrench 10.

A cam assembly, generally designated as 92, is positioned within the cam receiving portion 42 of the cavity 38. The cam assembly comprises a friction cam shoe 94 which has a generally convex arcuate cam surface 96 that is in close proximity to the convex friction surface 60 of the friction wheel 56. In one embodiment, the cam surface 96 may be thought of as being defined by a portion of the curved surface of a fictitious cylinder whose longitudinal axis is substantially parallel with the longitudinal axis of the friction wheel. The fictitious cylinder has a diameter greater than that of the friction wheel. Opposite the cam surface 96 the friction cam shoe contains a concave arcuate portion 105 dimensioned to mate with the shaft 71 of the thumb switch 26.

In other respects, the cam shoe 94 is generally rectangular in shape with side faces 141 and front and rear faces 143. Midway between the front and rear faces on the arcuate surface 96 is a slight concave depression 81. This depression allows free-wheeling of the friction wheel 56 when the wrench is in a neutral position. Located near the center of the cam shoe is an outwardly extending cam pin or boss 83 emanating from the front face 143.

Positioned within a recess 110, defined by the mounting of upper bearing housing 27 in bore 25, is a shifter actuator spring 112. With reference to its orientation in FIG. 3, the actuator spring 112 contains a pair of lower leg portions 114 spaced from each other to define a slot 116 for receiving both the cam pin 83 of the cam shoe 94 and the shifter pin 73 of the thumb switch 26. Above the legs 114, the actuator spring structure continues and is completed by a ring portion 122 that surrounds the friction wheel surface 60.

With reference to FIGS. 4 and 5, the operation of the wrench 10 will now be described. With a socket 130 secured to the drive tang 18 (see for example FIG. 28), the wrench is positioned in a conventional manner on a bolt, screw, or the like. With the knob 26 in its neutral position (FIG. 4) the surface of the depression 81 is proximate the friction surface 60 thus permitting the friction wheel to rotate in two directions relative to the head of the wrench. The knob 26 may be rotated from its neutral position in either a clockwise or counter-clockwise direction depending on the ultimate direction of rotation to be applied to the bolt. As best seen in FIGS. 4 and 5, a counter-clockwise rotation of the knob advances the shifter pin 73 in a counter-clockwise direction (FIG. 5) until the pin touches detent 111. The shifter pin acts on one of the legs 114 to cause the actuator spring 112 to move in a generally clockwise direction, thus causing the cam shoe 94 to move generally to the left and to set the cam assembly in the position shown in FIG. 5. In this position, the cam surface 96 is in proximate contact with the friction surface 60 of the friction wheel 56. For purposes of this discussion, the friction wheel is assumed to remain stationary. Thus, imparting a clockwise force F2 on the handle 14 has no effect on the friction wheel 56 and the handle is free to rotate about the friction wheel. However, imparting a counter-clockwise force of magnitude F2 to the handle causes frictional engagement between the friction surface 60 of the friction wheel 56 and the cam surface 96, thus imparting a counter-clockwise motion to the friction wheel.

By rotating the knob 26 in a counter-clockwise direction through the neutral position (FIG. 4) until its advancement is stopped by the detent structure 111 provided in the cavity 38, the procedure is reversed so that only a clockwise motion of the handle imparts a clockwise movement to the friction wheel.

FIG. 5 illustrates the considerations for determining the forces acting upon the wrench body 30 and cam assembly 92 as a result of a given torque load. The force F3 acting upon the wrench body 30 required to deliver a torsional force F1 through the frictional cam shoe 94 is shown to be proportional to the frictional contact radius R of the friction wheel 56 and the coefficient of friction $M_u$ of the wedging cam shoe 94 and the friction wheel 56. It has been determined that the larger the radius of the driven member or friction wheel, the less frictional force will be required to deliver a given torsional moment to the bolt being fastened. It is essential, therefore, in order to minimize the size of a wrench or free-wheeling clutch, to provide the largest frictional wheel radius possible within the restrictions of the available space envelope 40 in the head of the wrench.

In order to achieve maximum torque and durability, certain features should be maximized and others should be minimized. For best results, the friction wheel radius R, the nonslip pressure angle a, and the breakway leverage should all be maximized. The unit load and deflection should be minimized. As used herein, the nonslip pressure angle a (See FIG. 5,) is the angle that determines the amplitude of force F3, which is the force acting upon the cam shoe 94 and the wrench body 30 via the shaft 71 of the thumb switch 26. The "break away force" may be defined as the force required to reverse the wrench tang 18 when a torque has been applied to accomplish low-torque free-wheeling (free rotation in the direction opposite to the applied torque). Finally, "unit load" may be defined as the amplitude of the force F3 divided by the area over which force F3 is distributed.

For example, the pressure angle a, where the cam surface 96 engages the friction wheel 56, will cause sticking if it is too low (below approximately 7½°). However, if the same angle is too great (above approximately 12°) slipping will occur. In order to control this critical angle, deflection, unit load, and tolerances of parts should be minimized.

Figure 8:
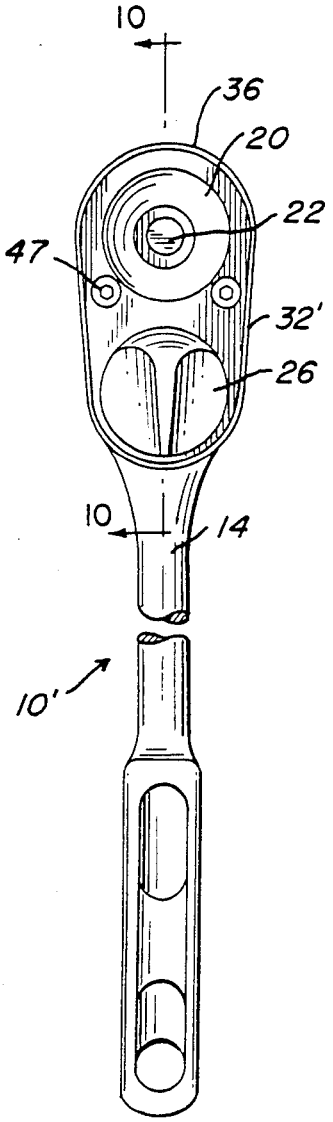
FIG. 8 is a top plan view of another embodiment of the wrench.
Figure 9:
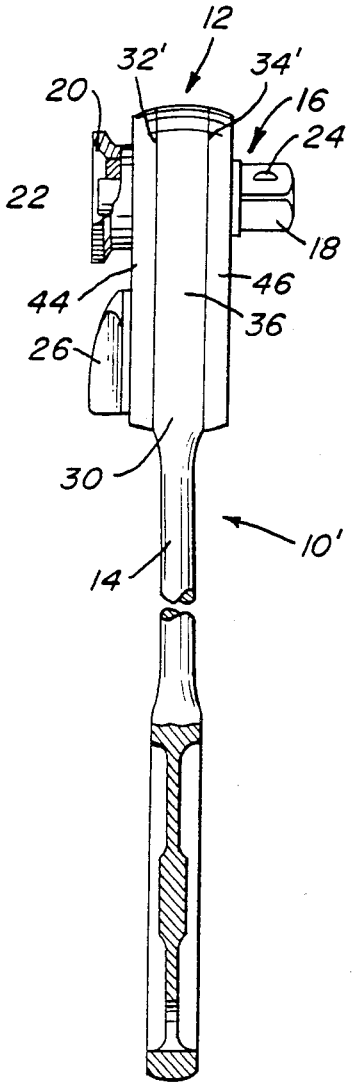
FIG. 9 is a side plan view of the embodiment of the wrench shown in FIG. 8.

With reference to FIGS. 8 through 15, an alternative embodiment of the subject invention will be described. Elements of the alternative embodiment performing a function similar to those of the first embodiment carry the same reference numerals. With reference to FIGS. 8 and 9, the wrench, generally designated as 10′, basically comprises a driving member in the form of a wrench head 12 from which depends an enlongated handle portion 14. Mounted for relative rotational movement within the head 12 is a driven member in the form of a friction wheel assembly 16 which terminates in a drive tang 18 for releasably receiving a hollow socket member or other type of fixture.

The wrench 10′ also includes a speed-wheel 20 fixedly mounted to the friction wheel 16. The speed-wheel, which is used primarily for rapid spin-down of fasteners, is conveniently located on the side of the wrench opposite to that of the drive tang 18. Concentric with the speed-wheel is a plunger 22, which together with a disc 24 located in the drive tang 18, forms part of a quick release mechanism, the details of which will be described hereinafter.

Located on the same side of the housing as the speed-wheel, but spaced therefrom, is a thumb switch 26 which is movable into one of three positions in order to determine in which direction the friction wheel assembly 16 will turn in response to a force applied to the handle 14 of the wrench 10′.

With references to FIGS. 8 through 15, the details of this alternative embodiment of the subject invention will be described. The driving member of the wrench 10' has an enlongated main body portion 30 integral with a longitudinally extending enlongated handle 14. The main body portion or head of the wrench defines two substantially planar outer surfaces 32' and 34' spaced a predetermined distance from each other to define a peripheral body wall 36 therebetween. The body wall 36 merges with the handle at one end of the head. Within the head there is defined a cavity 38 which extends from the distal end of the head in the general direction of the handle. The cavity 38 defines a friction wheel receiving portion 40 and a cam assembly receiving portion 42.

Covers 44 and 46, respectively, mate with and substantially cover surfaces 32' and 34' of the wrench head 36. The covers are positioned on the wrench head by cover dowels 93 and are fixedly mounted by a suitable means, such as screws 95.

The friction wheel assembly 16 basically comprises an enlongated shaft member 50 which terminates at one end in a conventional, generally square shaped, drive tang 18. Spaced along the shaft member in a direction away from the drive tang, the shaft member 50 has a generally reduced circumferential portion 54' followed by a cylindrical portion 56 of increased radius, which, in turn, is followed by a cylindrical portion of reduced radius 58' similar to that of cylindrical portion 54'. The cylindrical portion of increased radius defines a friction wheel 56' which provides, as its outer surface, a friction surface 60 radially disposed about the axis of the shaft in a closed geometric pattern. As best seen in FIGS. 5 and 6, the shaft 50 is disposed within the head of the wrench so that the friction wheel occupies the portion 40 of the cavity 38. A series of bearing rollers 61 are disposed about the circumferences 63', 65' of the reduced portions 54', 58' so that each may be received within apertures 239 provided in each of the covers. It is to be noted, however, that there are many known lubricants (for example silicon) which, if used, would obviate the need for roller bearings 61.

The friction wheel 50 contains a longitudinally extending bore 62 within which is received the quick release assembly generally designated 64. The details of this assembly will be described in detail hereinafter. At the end opposite to that of the tang drive 18, the friction wheel terminates in a cylindrically shaped shaft portion 66 to which is fixedly mounted the speed wheel 20.

Figure 10:
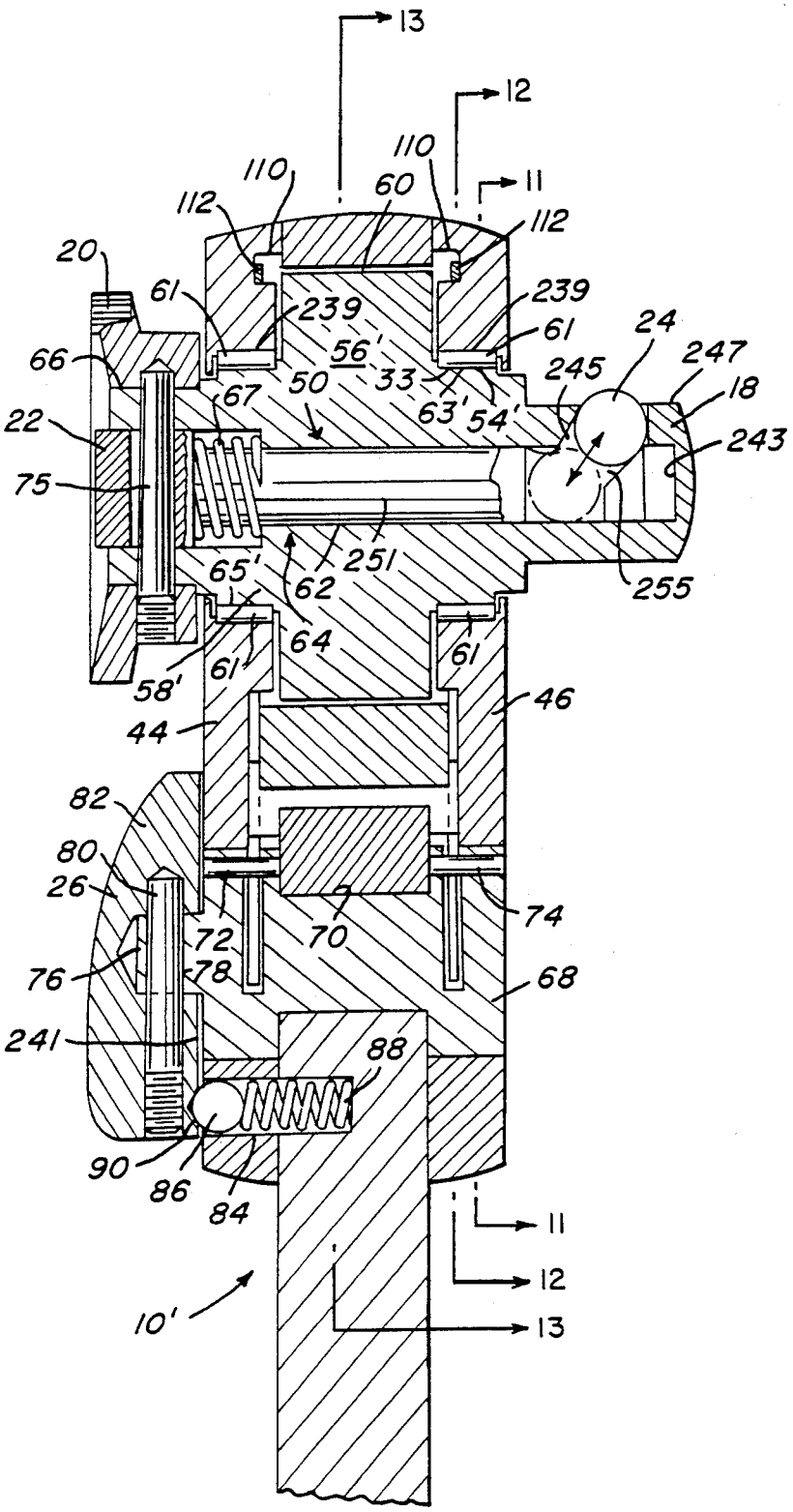
FIG. 10 is a view taken along lines 10—10 of FIG. 8.
Figure 11:
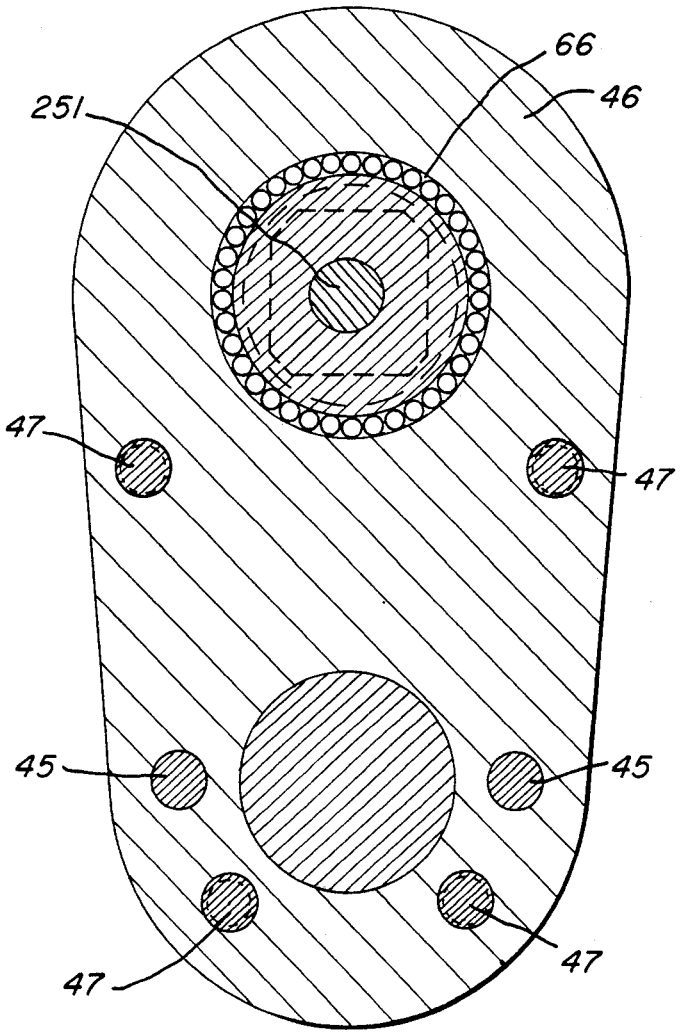
FIG. 11 is a view taken along lines 11—11 of FIG. 10.

As oriented in FIG. 10, a shifter lever 68 is rotatably mounted near the handle portion of the head. The shifter lever is cylindrically shaped with a cylinder 70 of reduced dimension defined near the middle of the structure; thus, creating two cylindrical portions 72, 74 of greater dimension on either side. At the end wall 241 of cylindrical portion 72 the shifter lever terminates in a shaft or projection 76 which contains a radial aperture 78 for receiving a shift lever pin 80 that is used for mounting a shift lever knob 82 to the shift lever 68.

The various cylindrical portions of the shift lever 68 are dimensioned so that the cylinder portion 70 occupies the main body portion 30 of the head and the cylindrical portions 72 and 74 occupy the cover portions 44, 46 of the head.

A bore 84 is provided in cover 44 and a portion of the head to receive a ball 86 and a compression spring 88. The knob 82 contains a detent 90 which cooperates with the ball and spring to provide a positive indication of a neutral position of the wrench mechanism.

A cam assembly, generally designated as 92, is positioned within the cam receiving portion 42 of the cavity 38. The cam assembly comprises a friction cam shoe 94' which has a generally concave arcuate cam surface 96' that is in close proximity to the convex friction surface 60 of the friction wheel 56. In a preferred embodiment, the cam surcace 96' may be thought of as being defined by a portion of the curved surface of a fictitious cylinder whose longitudinal axis is substantially parallel with the longitudinal axis of the friction wheel. The fictitious cylinder has a diameter greater than that of the friction wheel. Opposite the cam surface 96' the friction cam shoe contains two concave arcuate portions 98 configured to receive two cylindrically shaped cam pins 100. A shifter stop lug 102 completes the positioning of the cam pins 100 by providing a pair of concave arcuate portions 104. Opposite these arcuate portions the shifter stop lug 102 contains a further concave arcuate portion 105 dimensioned to mate with the cylindrical portion 70 of the shifter lever 68.

Positioned within recesses 110 provided in each of the covers is a shifter actuator spring 112. With reference to their orientation in FIG. 4, each of the actuator spring 112 contain a pair of lower leg portions 114 spaced from each other to define a slot 116 for receiving a shifter pin 118 which is contained in the shifter lever 68. Above the legs 114, each actuator spring structure continues by defining an open area 120 dimensioned to receive the ends of the cam pins 100. Above the area 120, each actuator spring structure is completed by a ring portion 122.

Figure 12:
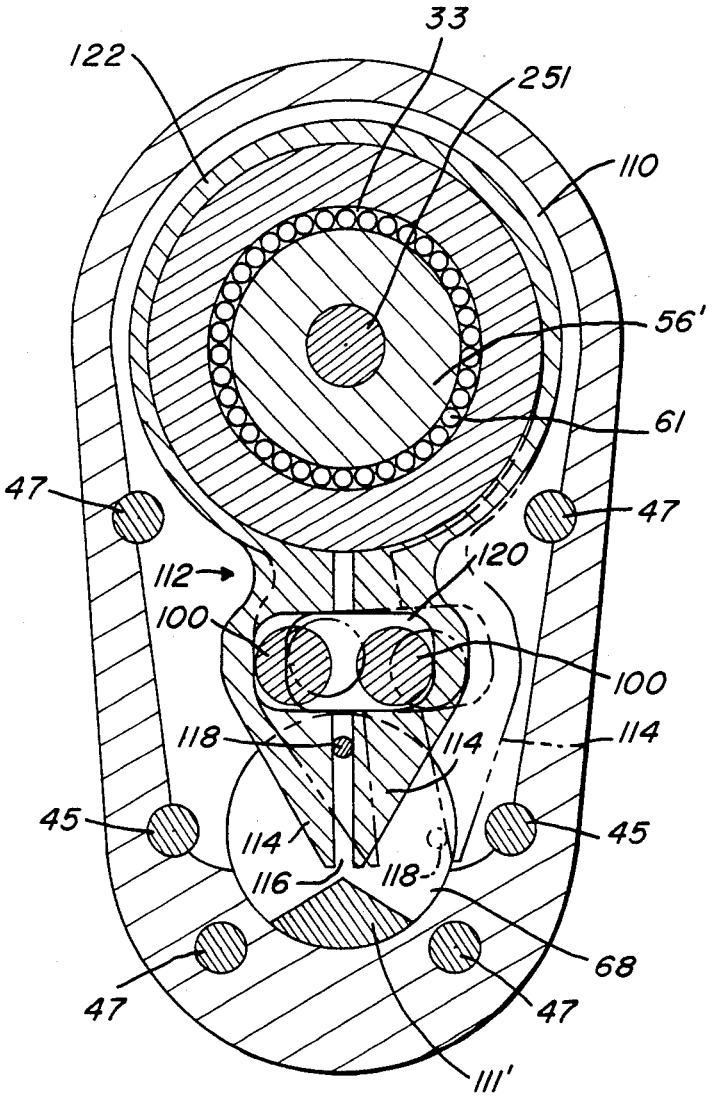
FIG. 12 is a view taken along lines 12—12 of FIG. 10.
Figure 13:
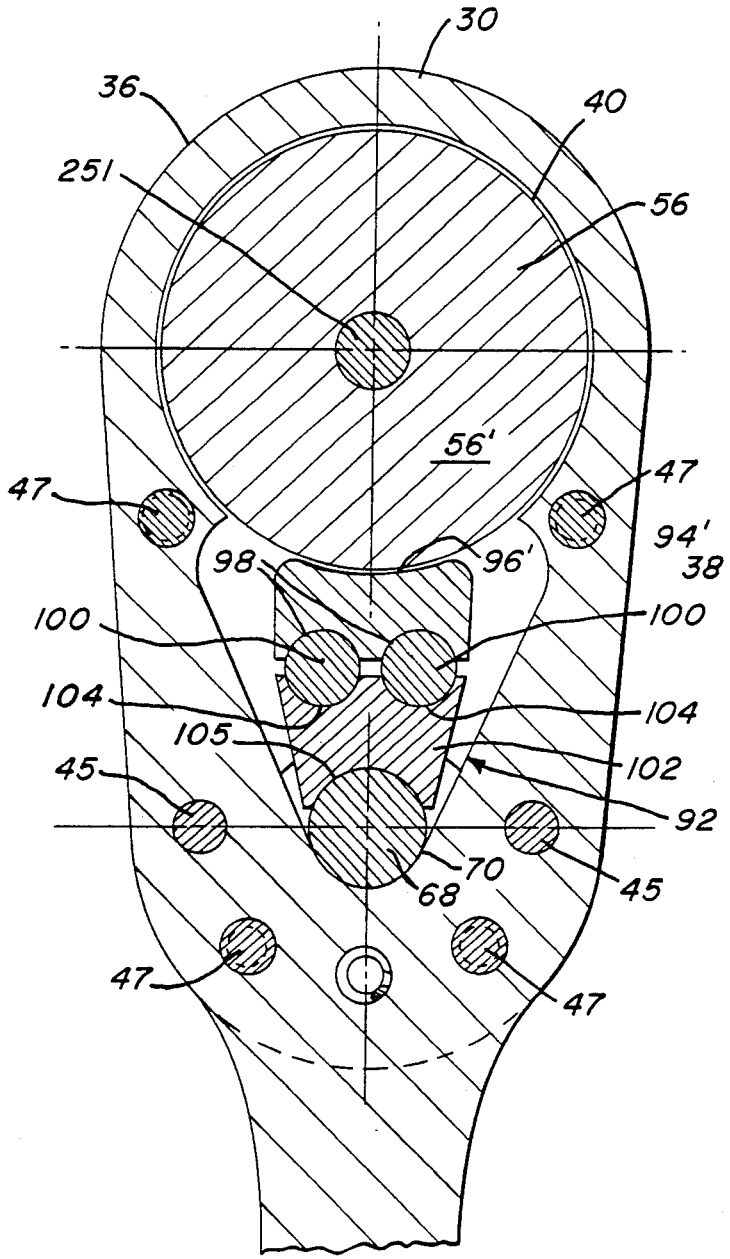
FIG. 13 is a view taken along lines 13—13 of FIG. 10.
Figure 14:
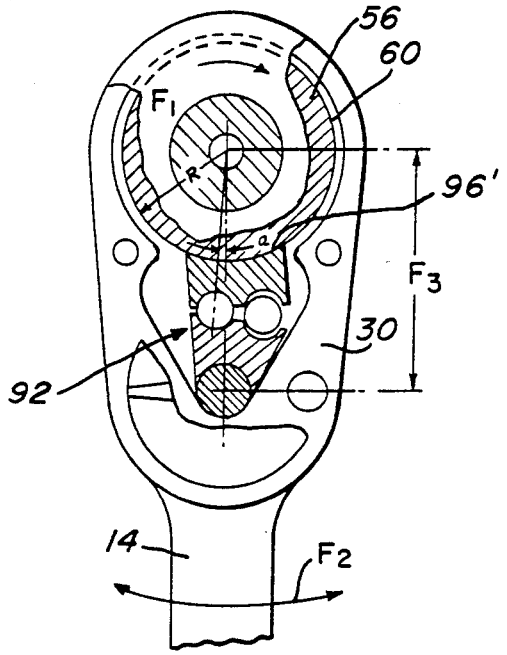
FIG. 14 is a schematic view used to illustrate the operation of the wrench embodiment of FIG. 8.

With reference to FIGS. 12 through 15, the operation of the wrench 10' will now be described. With a socket 130 (FIG. 28) secured to the drive tang 18, the wrench is positioned in a conventional manner on a bolt, screw, or the like. The knob 26 is then rotated from its neutral position (FIGS. 8 and 13) in either a clockwise or counter-clockwise direction depending on the ultimate direction of rotation to be applied to the bolt. As best seen in FIGS. 12 and 14, a clockwise rotation of the knob advances the shifter pin 118 in a clockwise direction as shown in phantom in FIG. 12. The shifter pin acts on one of the legs 114 to cause each actuator spring 112 to move in a generally counter-clockwise direction, thus causing the cam pins 100 to move generally to the right and to set the cam assembly in the position shown in FIG. 14. In this position, the cam surface 96' is in contact with the friction surface 60 of the friction wheel 56. For purposes of this discussion, the friction wheel is assumed to remain stationary. Thus, imparting a counter-clockwise force F2 on the handle 14 has no effect on the friction wheel 56 and the handle is free to rotate about the friction wheel. However, imparting a clockwise force of magnitude F2 to the handle causes frictional engagement between the friction surface 60 of the friction wheel 56 and the cam surface 96', thus imparting a clockwise motion to the friction wheel.

Figure 15:
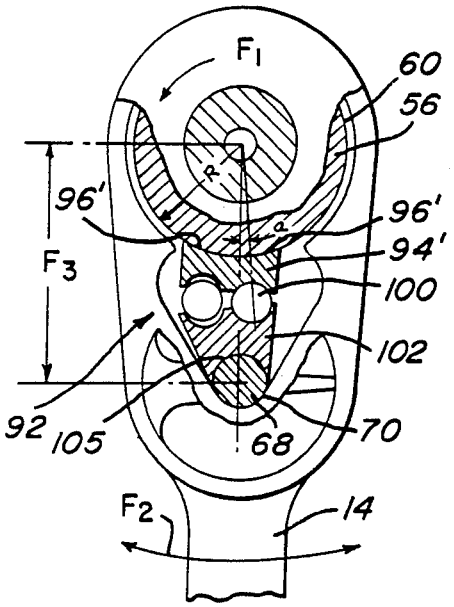
FIG. 15 is another schematic view used to illustrate the operation of the embodiment of FIG. 8.
Figure 16:
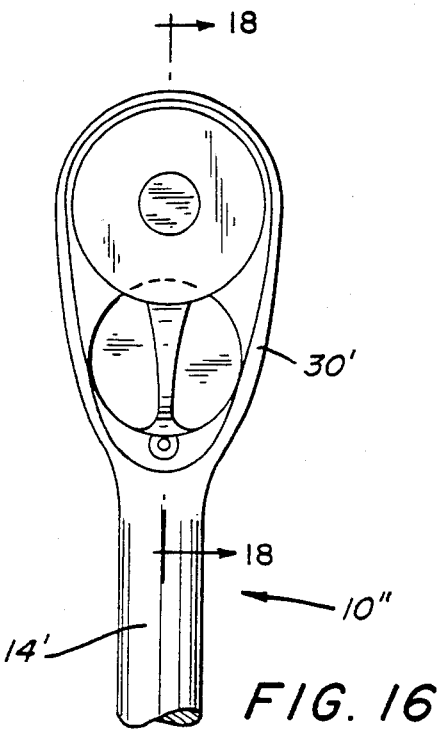
FIG. 16 is a top plan view of yet another embodiment of the wrench with a portion of the handle removed.
Figure 17:
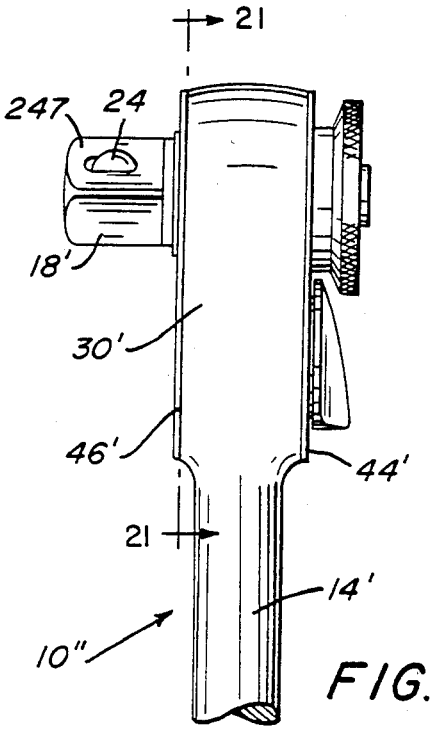
FIG. 17 is a side plan view of the embodiment of FIG. 16, also, with a portion of the handle removed.
Figure 18:
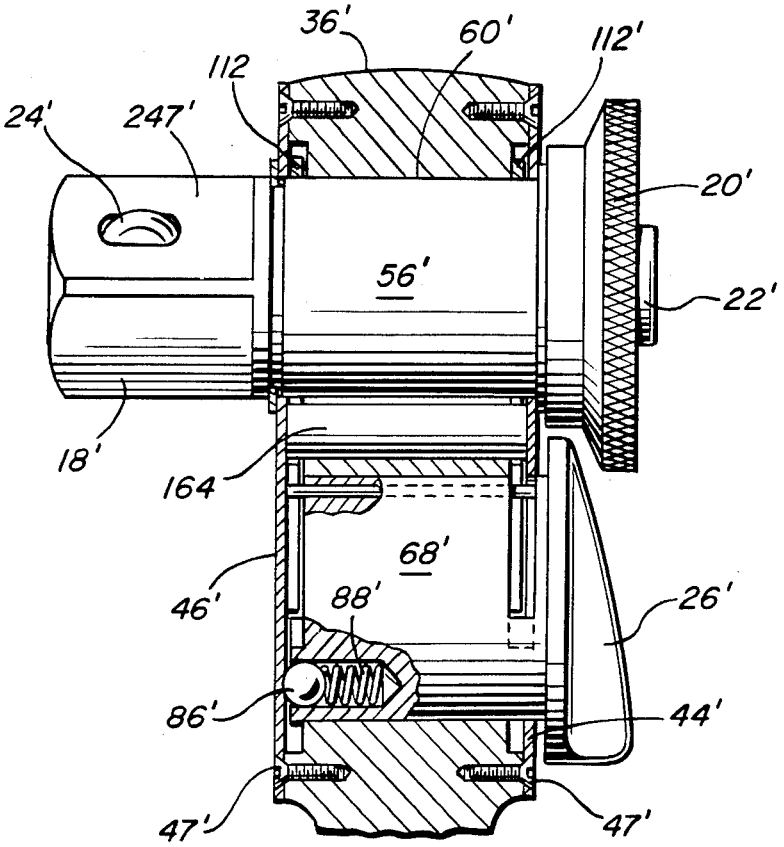
FIG. 18 is a view taken along lines 18—18 of FIG. 16.
Figure 20:
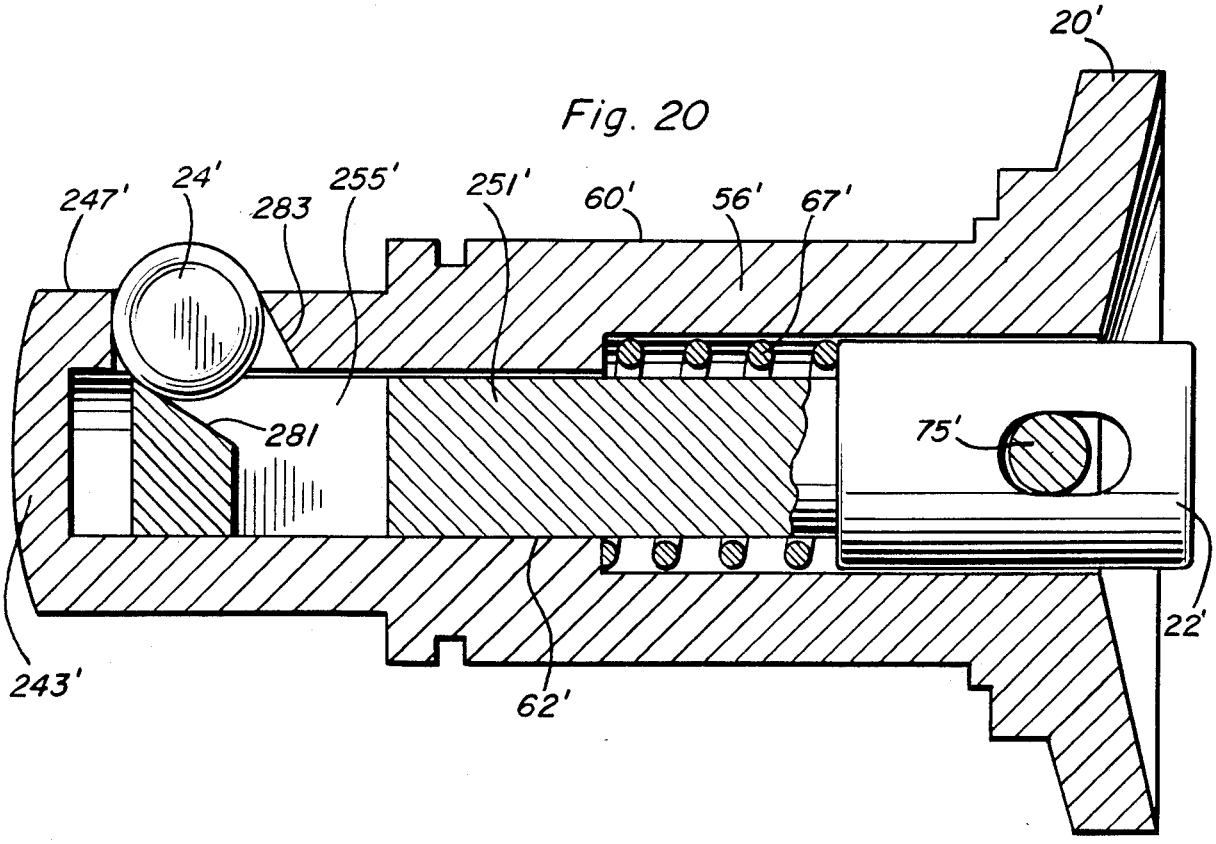
FIG. 20 is a view taken along lines 20—20 of FIG. 19.
Figure 19:
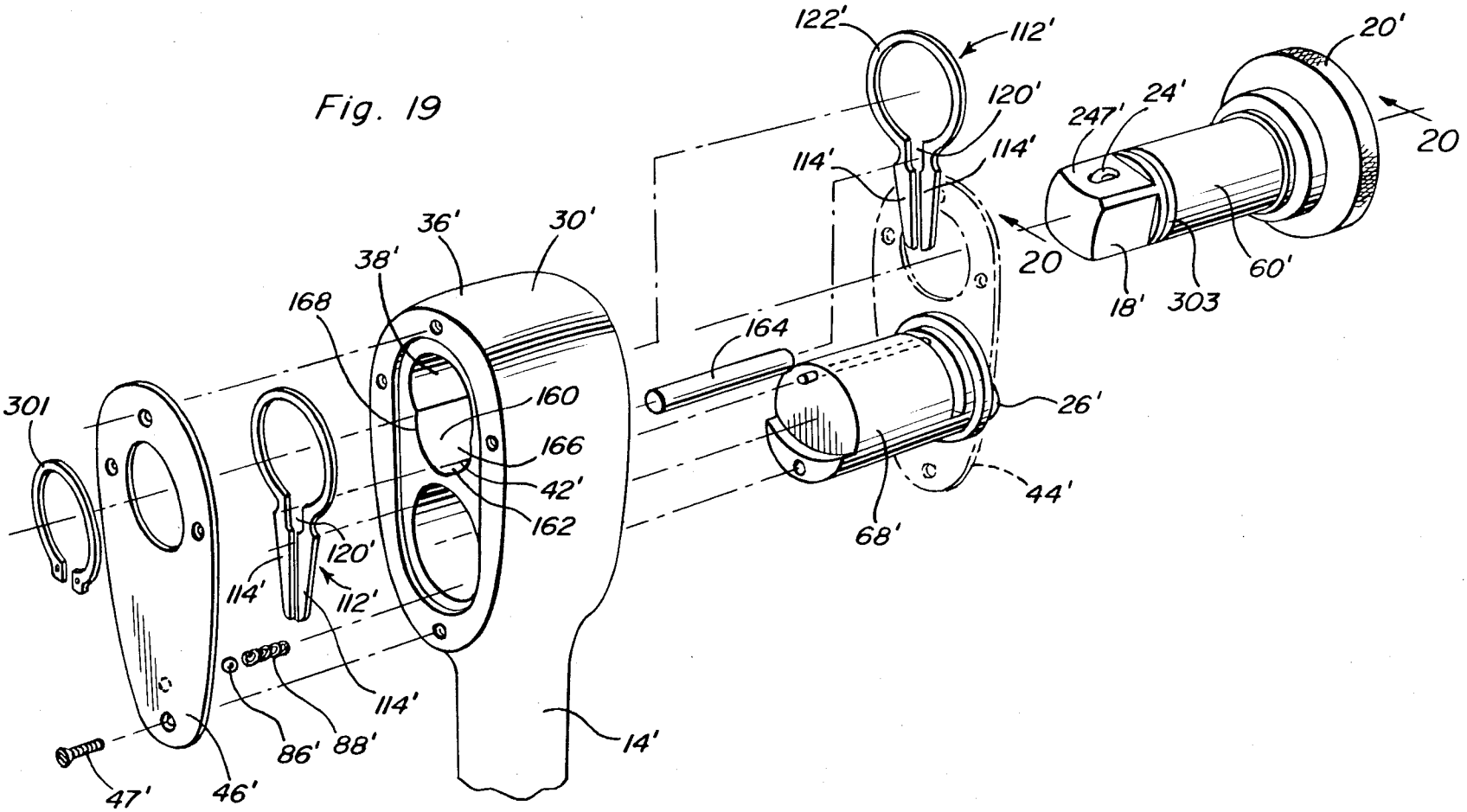
FIG. 19 is an exploded view of the embodiment shown in FIG. 16.
Figure 21:
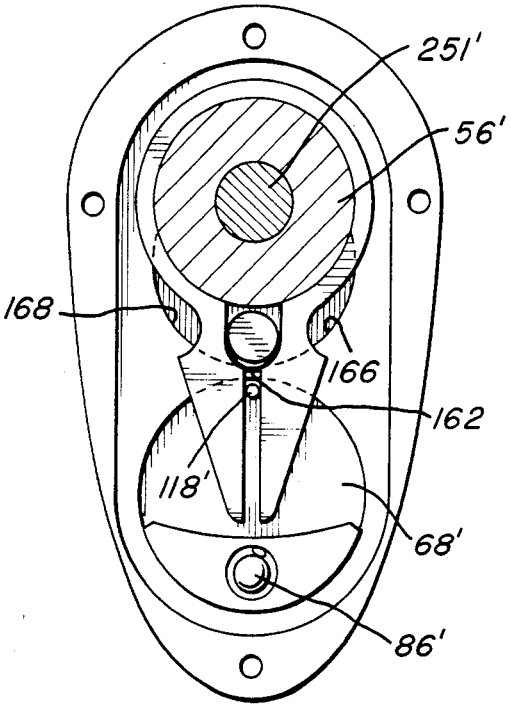
FIG. 21 is a view taken along lines 21—21 of FIG. 17 and is used to show the wrench in its neutral position.
Figure 22:
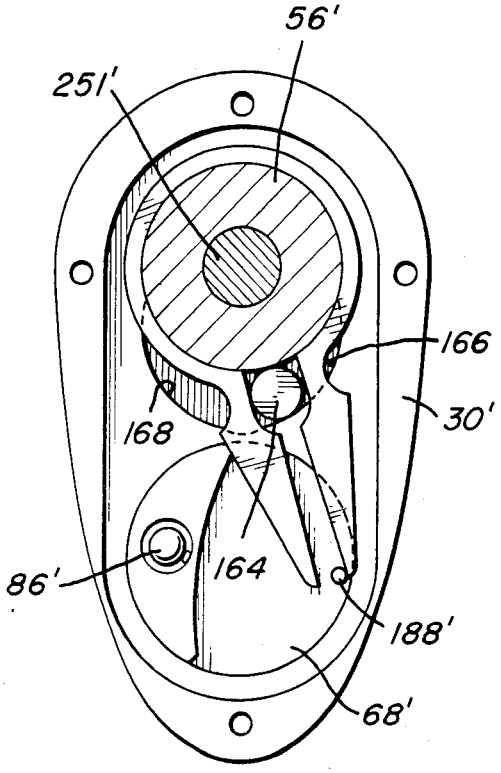
FIG. 22 is a view similar to that of FIG. 21 and shows the wrench in one of its operative positions
Figure 23:
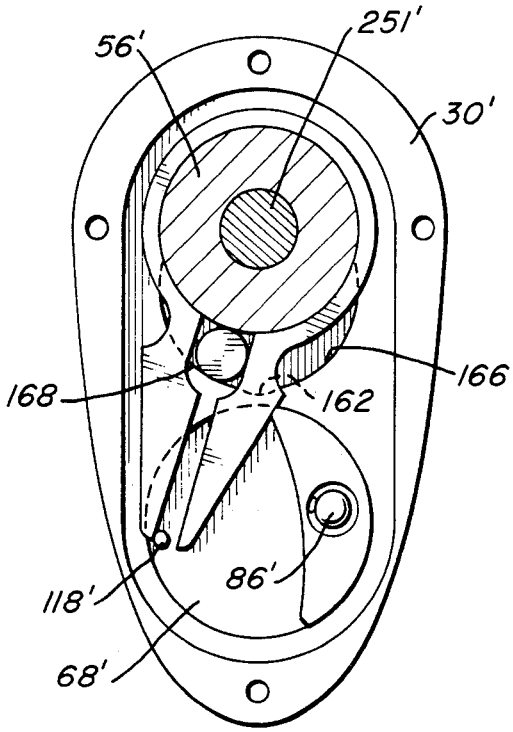
FIG. 23 is a view similar to FIG. 21 and shows the wrench in the other of its operative positions.

By rotating the knob 26 in a counter-clockwise direction through the neutral position until its advancement is stopped by the detent structure 111' provided in the shifter lever 68, the procedure is reversed so that only a counter-clockwise motion of the handle imparts a counter-clockwise movement to the friction wheel as shown in FIG. 15.

FIGS. 14 and 15 illustrate the considerations for determining forces acting upon the wrench body 30 and cam assembly 92 as a result of a given torque load. The force F3 acting upon the wrench body 30 required to deliver a torsional force F1 through the frictional wedge 94 is shown to be proportional to the frictional contact radius R of the friction wheel 56 and the coefficient of friction $M_u$ of the wedging cam members 94, 102 and friction wheel 56. It has been determined that the larger the radius of the driven member or friction wheel, the less frictional force will be required to deliver a given torsional moment to the bolt being fastened. It is essential, therefore, in order to minimize the size of a wrench or free-wheeling clutch, to provide the largest frictional wheel radius possible within the restrictions of the available space envelope 40 in the head of the wrench. As is evident, the force-determining considerations when using a multi-piece cam assembly are the same as those when use is made of a unitary cam member.

With reference to FIGS. 16 through 23, yet another embodiment of the subject invention will be described. This embodiment is similar in operation to the other embodiments with the exception of an alternative cam arrangement. Therefore, common elements between the three embodiments will carry primed reference numerals and only the differences will be described.

With reference to FIGS. 16 through 19, the head of the wrench 10'' has a greatly enlarged head portion 30' defining a unitized construction with the covers 44' and 46' being much thinner. In this embodiment, the covers are used to captivate the friction wheel 56' within the cavity 38' formed in the head. The friction wheel is held in place by a retaining spring 301 which fits within axial groove 303 defined about friction surface 60' near the drive tang 18'. The cam-receiving portion 42' of the cavity has been redefined to provide an eccentric arc 160 analogous to an inclined plane. At the bottommost portion of the arc, there is located a transverse detent 162 which receives a cylindrical cam roller 164 when the wrench is in the neutral position. The cam roller is mounted in the cavity so that the longitudinal axis of the cam roller is substantially parallel to the longitudinal axis of the friction wheel.

The actuator springs 112' are similar to those employed in the second embodiment except that the open area 120' in each spring is made much smaller to accommodate and move the single cylindrical cam roller 164. The mechanism works in the same manner as the previous two embodiments through manipulation of the knob 26' in order to shift the cam roller 164 up either inclined plane 166, 168.

With reference to FIGS. 24 through 29, the quick release mechanism 64 associated with all of the embodiments will now be described. With reference to FIG. 24, the friction wheel 56 contains a longitudinally extending axial bore 62 which is closed at the end 243 of the drive tang 18. Within the area of the drive tang, the bore defines a lateral slot 245 which opens to one of the flat faces 247 of the drive tang. Positioned within the bore is an elongated plunger 251 which has an elongated longitudinally-extending slot 255 dimensioned to freely and substantially completely receive a detent disc 24.

During assembly, the detent disc 24 is pre-installed in the plunger slot 255 and then is positioned within the bore 62 so that the disc 24 is free to roll into the slot 245 provided in the tang drive portion 18 of the friction wheel 50. The other end of the plunger terminates in an actuation button 22 which is configured so that the plunger 251 is urged out of the bore by a compression spring 67. The release button contains a transverse bore 271 that freely receives a plunger pin 275 which is held in bore 271 by screw 277 and which is used to limit the longitudinal movement of the plunger and to secure the speed-wheel 20 to the friction wheel shaft 50. For the first embodiment, the transverse bore and plunger pin are replaced by a retaining ring 201 received within a groove 203 provided in the speed wheel portion 20. Defined on the plunger 251 a short distance from the button 22 is a rim portion 205, which together with the button 22 defines a retainer pin receiving space 207 that limits the travel of the plunger. In this way, the detent disc 24 is captivated, and cannot be completely disengaged from the cam surface of inclined plane 281 due to the dimensional control of the plunger by the slot 271 and the plunger pin 275. Angle b (FIG. 25), formed between the cam surface of inclined plane 281 and the cam surface of inclined plane 283, must be substantially greater than 14½° to avoid sticking of detent disc, with an angle of approximately 25° being preferred. Angle c, formed between the cam surface of incline plane 281 and the axis F of the plunger 251 must be greater than 45° to result in the desired feature of easy engagement of the socket 130, while being relatively more difficult to release the socket, with the preferred angle being approximately 55°.

With reference to FIG. 26, the square drive tang 18 is shown being pushed into a socket 130. Detent disc 24 moves upward and inward toward the center of the slot 255 in the plunger 251. The plunger is moved downward by virtue of the force factors created by angle b thereby compressing the spring 67. Disc 24 rotates in the counter-clockwise direction, further enhancing downward movement of the plunger by virtue of frictional contact. It is not necessary to push the plunger downward. The entire action occurs from a relatively light pressure on the socket, thus allowing for single hand engagement of the socket.

With reference to FIG. 28, the socket 130 is fully engaged with the drive tang 18. The plunger 251 is maintained upward by the spring biasing detent disc 24 to maintain engagement with detent relief 180 in the socket. In this position, downward movement of the socket moves the detent disc, generally disengaged from incline plane 283, inward toward plunger 251, also urging the detent disc to rotate clockwise tending to urge the plunger upward. The plunger is also forced against the wall of the tang hole from vector action by virtue of the incline plane 281 and angle c. It is, therefore, much more difficult to remove the socket from the tang than engaging the socket with the tang.

As best seen in FIG. 29, the plunger 251 is pushed downward by thumb action, the disc 24 thus being free to move out of engagement with the detent release 180 and the socket 130 being released from the square drive tang 18. It should be noted that very slight motion of the plunger is required to release the socket.

Although the present invention has been shown and described in terms of specific preferred embodiments, it will be appreciated by those skilled in the art that changes or modifications are possible which do not depart from the inventive concepts described and taught herein. Such changes and modifications are deemed to fall within the pervue of these inventive concepts.

What is claimed is:

1. A stepless wrench comprising:

a wrench body having a cavity defined therein;

a shaft terminating at one end in a fixture-receiving portion, said shaft being mounted in said cavity for relative rotational movement in two directions, said rotational movement being about the longitudinal axis of said shaft;

a continuous, uninterrupted friction surface radially disposed about said shaft in a closed geometric pattern;

a cam shoe having a face on which are defined a first surface and a second surface;

means for movably mounting said cam shoe in said cavity;

cam positioning means for alternately placing said first surface proximate said friction surface for limiting said relative rotational movement to only one of said two directions, and for placing said second surface proximate said friction surface for limiting said relative rotational movement to only the other of said two directions.

2. The stepless wrench of claim 1 wherein said face further defines a third surface, and said cam positioning means is further operative for placing said third surface proximate said friction surface for permitting said relative rotational movement in both of said two directions.

3. The stepless wrench of claim 2 wherein said third surface is an elongated concave trough whose longitudinal axis is substantially parallel to said axis of said shaft.

4. The stepless wrench of claim 1, wherein at least one of said first and second surfaces are substantially planar.

5. The stepless wrench of claim 1, wherein at least one of said first and second surfaces are defined by a portion of the curved surface of a cylinder whose longitudinal axis is substantially parallel with said axis of said shaft.

6. The stepless wrench of claim 1, further comprising means for facilitating manual rotation of said shaft, said means being positioned on the other end of said shaft.

7. The stepless wrench of claim 1, further comprising release means, movably mounted in said shaft, for readily permitting mounting of a fixture on said fixture receiving portion and for normally preventing removal of the fixture once it has been mounted.

8. The stepless wrench of claim 7, wherein said release means further comprises means for permitting ready removal of the fixture.

9. The stepless wrench of claim 2 wherein said first, second and third surfaces are defined by a portion of the curved surface of a cylinder whose longitudinal axis is substantially parallel with said axis of said shaft.

10. The stepless wrench of claim 1, wherein said cam shoe mates with a cylinder, said cylinder being mounted in said cavity so that the longitudinal axis of said cylinder is substantially parallel to said axis of said shaft.

11. The stepless wrench of claim 2, wherein said first and second surfaces are arranged on said face along a line which is substantially perpendicular to said axis of said shaft.

12. The stepless wrench of claim 11, wherein said third surface is interposed between said first and second surfaces along said line.

13. The stepless wrench of claim 1, wherein said cam positioning means comprises shifting means movably mounted in said cavity for rotation about said shaft, and selector means, movably mounted in said wrench body, for rotating said shifting means, and wherein said stepless wrench further comprises translating means for translating movement of said shifting means into movement of said cam shoe.

14. The stepless wrench of claim 13, wherein said shifting means comprises a ring-shaped member having a pair of legs extending radially outward therefrom, said legs spaced from each other to define an open area therebetween, said open area forming part of said translating means.

15. The stepless wrench of claim 14, wherein said translating means further comprises a boss member positioned on said cam shoe, said boss member positioned within said open area between said legs of said ring-shaped member so that movement of said ring-shaped member is translated to said cam shoe through contact of at least one of said legs with said boss member.

16. A clutch apparatus comprising:

a drive member having a cavity defined therein;

a shaft member having a continuous uninterrupted friction surface radially disposed about its axis in a closed geometric pattern, said shaft member being mounted in said cavity for relative rotational movement in two directions, said rotational movement being about the longitudinal axis of said shaft;

a cam shoe having a face on which is defined a first surface and a second surface;

means for movably mounting said cam shoe in said cavity;

cam positioning means for alternatively placing said first surface proximate said friction surface for limiting said relative rotational movement to only one of said two directions, and for placing said friction surface for limiting said relative rotational movement to only the other of said two directions.

17. The clutch apparatus of claim 16 wherein said face further defines a third surface, and said cam positioning means is further operative for placing said third surface proximate said friction surface for permitting said relative rotational movement in both of said two directions.

18. The clutch apparatus of claim 17 wherein said third surface is an elongated concave trough whose longitudinal axis is substantially parallel to said axis of said shaft.

19. The clutch apparatus of claim 16, wherein said cam positioning means comprises shifting means movably mounted in said cavity for rotation about said shaft, and selector means, movably mounted in said drive member, for rotating said shifting means, and wherein said clutch apparatus further comprises translating means for translating movement of said shifting means into movement of said cam shoe.

20. The clutch apparatus of claim 19, wherein said shifting means comprises a ring-shaped member having a pair of legs extending radially outward therefrom, said legs spaced from each other to define an open area therebetween, said open area forming part of said translating means.

21. The clutch apparatus of claim 20, wherein said translating means further comprises a boss member positioned on said cam shoe, said boss member positioned within said open area between said legs of said ring-shaped member so that movement of said ring-shaped member is translated to said cam shoe through contact of at least one of said legs with said boss member.

22. A stepless wrench comprising:

a wrench body having a cavity defined therein, said cavity including a dedicated cam-contacting surface;

a shaft terminating at one end in a fixture-receiving portion, said shaft being mounted in said cavity for rotational movement about the axis of said shaft;

a continuous, uninterrupted friction surface radially disposed about said shaft in a closed geometric pattern, cam means positioned within said cavity for selectively contacting said friction surface and said cam-contacting surface, said cam means operable in three positions, in a first position to permit relative rotational movement between said wrench body and said shaft in two directions, in a second position to permit relative rotational movement in only one of said two directions, and in a third position to permit relative rotational movement in the other of said two directions; and selecting means for selectively placing said cam means in any one of said three operative positions.

23. The stepless wrench of claim 22, wherein said cam means comprises a cam shoe having a face on which is defined a first surface, a second surface, and a third surface, said first surface being placed proximate said friction surface when said cam means is in said first position, said second surface being placed proximate said friction surface when said cam means is in said second position and said third surface being placed proximate said friction surface when said cam means is in said third position.

24. The stepless wrench of claim 23 wherein said first surface is an elongated concave trough whose longitudinal axis is substantially parallel to said axis of said shaft.

25. The stepless wrench of claim 22, further comprising means for facillating manual rotation of said shaft, said means being positioned on the other end of said shaft.

26. The stepless wrench of claim 22, further comprising release means, movably mounted in said shaft, for readily permitting mounting of a fixture on said fixture receiving portion and for normally preventing removal of the fixture once it has been mounted.

27. The stepless wrench of claim 26, wherein said release means further comprises means for permitting ready removal of the fixture.

28. The stepless wrench of claim 22, further comprising a handle secured to said wrench body for effective leverage in turning.

29. A clutch apparatus comprising:

a drive member having a cavity defined therein, said cavity including a dedicated cam-contacting surface;

a shaft member having a continuous, uninterrupted friction surface radially disposed about its axis in a closed geometric pattern, said shaft member being mounted in said cavity for rotational movement about its axis;

cam means positioned within said cavity for selectively contacting said friction surface and said cam-contacting surface, said cam means operable in three positions, in a first position to permit relative rotational movement between said drive member and said shaft member in two directions, in a second position to permit relative rotational movement in only one of said two directions, and in a third position to permit relative rotational movement in the other of said two directions; and selecting means for selectively placing said cam means in any one of said three operative positions.

30. The clutch apparatus of claim 29, wherein said cam means comprises a cam shoe having a face on which is defined a first surface, a second surface, and a third surface, said first surface being placed proximate said friction surface when said cam means is in said first position, said second surface being placed proximate said friction surface when said cam means is in said second position and said third surface being placed proximate said friction surface when said cam means is in said third position.

31. The clutch apparatus of claim 30, wherein said first surface is an elongated concave trough whose longitudinal axis is substantially parallel to said axis of said shaft.

32. A stepless wrench usable with a fixture having a detent, said wrench comprising:

a wrench body having a cavity defined therein;

elongated tube means terminating at one end in a fixture receiving portion, said tube means being mounted in said cavity for relative rotational movement in two directions, said rotational movement being about the longitudinal axis of said tube means;

a friction surface radially disposed about said tube means in a closed geometric pattern;

a cam shoe having a face on which is defined a first surface and a second surface;

means for movably mounting said cam shoe in said cavity;

cam positioning means for placing said first surface proximate said friction surface for limiting said relative rotational movement to only one of said two directions, and for placing said second surface proximate said friction surface for limiting said relative rotational movement to only the other of said two directions, said cam positioning means comprising shifting means movably mounted in said cavity for rotation about said shaft, said shifting means including a ring-shaped member having a pair of legs extending radially outwardly therefrom, said legs spaced from each other to define an open area therebetween, said open area forming part of said translating means, and selector means, movably mounted in said wrench body, for rotating said shifting means, and wherein said stepless wrench further comprises translating means for translating movement of said shifting means into movement of said cam shoe;

elongated plunger means having a disc-receiving end and an actuator end, said plunger means reciprocating in said tube means;

first slot means provided in said fixture-receiving end for permitting a portion of said disc to protrude out of said tube means, said first slot means including at least one inclined cam surface;

second slot means provided in said disc-receiving end for receiving said disc and for communicating with said first slot means, said second slot means including at least one inclined cam surface;

positioning means for normally placing said plunger means in a first position so that said second slot means urges said disc into said first slot means with a portion of said disc protruding out of said tube means;

repositioning means responsive to the movement of said disc for moving said plunger means to a second position to allow said disc to move from said first slot means into said second slot means during attachment of said fixture to said fixture-receiving end of said tube means;

said repositioning means becoming inactive and said positioning means becoming active to return said plunger means to said first position so that said portion of said disc occupies the detent of the fixture upon completion of the attachment of the fixture;

preventing means for preventing said disc from entering said second slot means when said disc is in the detent of the fixture and an attempt is made to remove the fixture from said fixture-receiving end of said tube means; and releasing means for placing said plunger means into a third position to allow said disc to move from the detent of the fixture into said second slot to permit easy removal of the fixture.

33. The stepless wrench of claim 32, wherein said translating means further comprises a boss member positioned on said cam shoe, said boss member positioned within said open area between said legs of said ring-shaped member so that movement of said ring-shaped member is translated to said cam shoe through contact of at least one of said legs with said boss member.

* * * * *